US005584190A

United States Patent [19]

Cole

[11] Patent Number: 5,584,190

[45] Date of Patent: Dec. 17, 1996

[54] FREEZER WITH HEATED FLOOR AND REFRIGERATION SYSTEM THEREFOR

[76] Inventor: Ronald A. Cole, 1111 W. Church Ave., Champaign, Ill. 61821

[21] Appl. No.: 533,616

[22] Filed: Sep. 25, 1995

[51] Int. Cl.[6] ..... F25B 27/00; F25D 13/00

[52] U.S. Cl. ..... 62/260; 62/259.1; 62/238.6; 165/45

[58] Field of Search ..... 62/260, 259.1, 62/430, 434, 453, 238.1, 238.6; 165/45, 57, 54, 104.11

[56] References Cited

U.S. PATENT DOCUMENTS

| | | | |
|---|---|---|---|
| 2,954,680 | 10/1960 | Ruff | 62/260 |
| 3,246,479 | 4/1966 | Kelley | 165/45 |
| 3,675,441 | 7/1972 | Perez | 62/278 |
| 3,782,132 | 1/1974 | Lohoff | 62/260 |
| 3,952,531 | 4/1976 | Turner | 62/45 |
| 5,383,339 | 1/1995 | McCloskey et al. | 62/238.5 |

OTHER PUBLICATIONS

1994 ASHRAE Handbook Refrigeration I–P Edition, Chapter 24 "Refrigerated Warehouse Design" pp. 24.1–24.13.

*Primary Examiner*—William Doerrler

*Attorney, Agent, or Firm*—Daniel Kramer

[57] ABSTRACT

A freezer box comprising an enclosure resting on soil, the soil having a tendency to freeze from the cooling effect of the freezer positioned above. Pipes, through which a warm fluid flows, thereby being cooled, buried under the freezer enclosure for warming and preventing the freezing of the sub-freezer soil. A refrigeration system having a condenser for receiving refrigerant vapor and condensing it to a warm liquid. An evaporator for producing cooling by evaporating the liquid refrigerant condensed by a condenser. A pipe for conveying the flow of warm liquid refrigerant from the condenser to the evaporator and a heat exchanger positioned to exchange heat between the flow of cool fluid, having warmed the soil under the freezer, and the flow of warm liquid refrigerant enroute through the pipe from the condenser to the evaporator, thereby warming the flow of fluid and cooling the flow of liquid refrigerant.

31 Claims, 5 Drawing Sheets

FREEZER WITH HEATED FLOOR AND REFRIGERATION SYSTEM THEREFOR

BACKGROUND

1. Field of the Invention

My invention relates to freezer enclosures which are positioned on grade or on soil and to refrigeration systems cooling such freezers and to means for improving the thermodynamic efficiency of such refrigeration systems while preventing freezing of the soil under the freezer enclosure.

2. Background

Frost Heaving, Cause:

When freezers are located on grade, there is heat flow from the ground on which the insulated floor of the freezer rests through the insulated floor to the freezer. Consequently the ground under the freezer floor tends to drop in temperature and eventually approach the temperature inside the freezer itself. As the ground under the freezer floor cools, the vapor pressure of water or moisture within the cooled ground drops. This reduction in water vapor pressure within the cooled ground under the freezer establishes a vapor pressure differential favoring water vapor flow from the warmer moisture residing elsewhere in the ground, and possibly from the moist air surrounding the freezer above grade, to the cooled earth under the freezer. There the moisture attracted by the cooler ground under the freezer condenses and eventually freezes.

Over a period of time, temperature changes within the freezer and seasonal changes of ground temperature, causes thawing and refreezing of the moisture that has been attracted to and now resides within the earth under the freezer. Eventually the freeze/thaw cycles cause expansion of the ice formed in the earth under the freezer to the extend that the freezer floor is bulged upward and is disrupted. This bulging of the freezer floor is called frost heaving.

Frost Heaving, Prevention, Prior Art;

While repair of a heaved floor by heating the bulged portion and area surrounding is sometimes effective to reduce the bulge, the floor is always damaged and subject to repeat heaving. Therefore the most effective long term remedy is removal and rebuilding of bulged floor with heat. Consequently, since it has long been known that frost heaving of unheated freezer floors erected on grade is likely to occur, conservative construction practice has required that means for heating the ground immediately underneath on-grade freezers be provided. In fact, the following statement appears at page 5 of chapter 24 "Refrigerated Warehouse Design" of the 1994 ASHRAE (American Society of Heating, Refrigerating and Air-Conditioning Engineers) Refrigeration Handbook under the heading "Floor Construction"

Refrigerated facilities held above freezing need no special under-floor treatment. A below-the-floor vapor barrier is needed in facilities held below freezing, however. In these facilities, the sub-soil eventually freezes, and any moisture in this soil will also freeze and cause floor frost heaving. In moderate climates, underfloor tubes vented to ambient air are sufficient to prevent heaving. Artificial heating, either by air circulated by underfloor ducts or glycol circulated through plastic pipe is the preferred method to prevent frost heaving. Electric heating cables installed under the floor can also be used to prevent frost formation. The choice of heating method depends on energy cost, reliability, and maintenance requirements.

"Further, in the same chapter at page 10 under the heading Floors", the following appears referring to circulation of a warmed liquid under the freezer.

"The pipe grid system . . . is usually best . . . A source of heat for this system can be obtained by a heat exchanger in the refrigeration system, steam or gas engine exhaust. The temperature of the recirculated fluid is controlled at 50 F. to 70 F., depending on design requirements. Almost universally the pipes are made of plastic.

The pipe grid system is usually placed in the concrete slab directly under the insulation . . . The fluid should be an antifreeze solution such as glycol with the proper inhibitor.

All known experiences related to the use of a heat exchanger in the refrigeration system to provide heat to the glycol stream place the heat exchanger either in series with the condenser at its hot gas inlet or in parallel in the condenser. Nowhere in the Handbook or elsewhere in the literature could there be found any reference to the potential usefulness of the cooling effect of the glycol solution, which had been employed for warming the freezer floor, for cooling or sub-cooling liquid refrigerant flowing to the expansion device.

Sub-Cooling and Refrigerant Liquid Temperature

Every compression type refrigeration system circulates a volatile refrigerant through a closed circuit having an evaporator, a compressor and a condenser. Volatile liquid refrigerant at a temperature is supplied to the evaporator from a condenser. The volatile liquid is evaporated to a vapor in the evaporator, thereby providing a desired cooling effect. For each pound of refrigerant that is evaporated in the evaporator a discrete amount of cooling is secured. The amount of cooling per pound of evaporated refrigerant increases as the temperature of the liquid supplied to the evaporator is decreased. In systems employing ammonia as the volatile refrigerant, a capacity gain of about 0.25 percent will be realized for each degree F the temperature of the liquid ammonia flowing to the expansion device is reduced.

In systems employing halocarbon refrigerants such as CFC-12, CFC-22 and CFC-502 a capacity gain ranging between 0.5 and 1.0 percent will be realized for each degree F the liquid temperature reaching the expansion device is reduced.

In simple refrigeration systems the temperature of the liquid supplied to the evaporator is closely related to the temperature at which the refrigerant vapor condenses in the condenser. Many strategies have been devised to reduce the temperature of the refrigerant liquid approaching the evaporator to a temperature well below the condensing temperature.

The most common is the use of a suction liquid heat exchanger where the warm liquid from the condenser is cooled by exchanging heat with and thereby warming the cold refrigerant vapor leaving the evaporator. Unfortunately, while the refrigerant liquid is cooled, the warmed suction vapor is now less dense and the compressor can pump less of it with each stroke, so that the net capacity increase from this strategy is small. Further, systems employing refrigerants which heat severely on compression such as ammonia and HCFC-22, can be harmed and their operational lives shortened by unnecessary heating of the suction vapor.

In air-conditioning systems it is common to provide a few extra tubes in the air-cooled condenser coil and to pass warm liquid refrigerant from the liquid receiver, or from the condenser outlet, through those tubes to secure only a few extra degrees of sub-cooling.

In systems employing evaporative condensers it is common to provide a sub-cooling coil in the water sump of the evaporative condenser through which liquid refrigerant from the liquid receiver is passed for the purpose of slightly lowering the liquid refrigerant temperature, thereby only slightly improving system efficiency.

The most desirable strategy would provide cooling effect to the liquid refrigerant employing some cold medium which would have to be heated in the normal course.

Therefore it is an object of the present invention to provide significant cooling effect to liquid refrigerant flowing from a condenser to an expansion device, for the purpose of substantially improving refrigeration cycle efficiency without any concomitant negative effect, from a glycol stream which has been employed to heat the underfloor of a freezer, the glycol thereby having been cooled to a temperature approaching 35 F.

It is a further object to use the cooling effect of such a glycol stream to cool and sub-cool liquid refrigerant flowing to an evaporator thereby simultaneously improving the thermodynamic efficiency of the system and supplying heat to and warming the glycol stream for recirculation again under the freezer floor.

It is a further object to use the cooling effect of such a glycol stream to cool and sub-cool liquid refrigerant flowing to an intercooler of a compound compression system thereby improving system efficiency and simultaneously supplying heat to and warming the glycol stream for recirculation again under the freezer floor.

It is a further objective of the present invention to use the cooling effect of such a glycol stream to cool and sub-cool the liquid refrigerant which is itself employed to cool the freezer whose floor is being warmed by the glycol.

It is a further object to employ the cooling effect of such a glycol stream for cooling a space.

It is a further object to use the cooling effect of such a glycol stream to cool and condition the air in an ante-room through which entry to the freezer is provided, thereby reducing both the sensible and latent load on the freezer and avoiding the need for supplying a supplementary system for this purpose.

It is a further object to employ the cooling effect of such a glycol stream to cool compressor oil which has been heated during the compression process.

It is a further object of the present invention to use the cooling effect of such a glycol stream simultaneously for two or more of the above purposes.

Further objects and advantages of my invention will become apparent from a consideration of the drawings and the ensuing description of the invention.

SUMMARY OF THE INVENTION

A freezer resting on soil which is subject to freezing has pipes, conveying warm glycol solution, positioned to warm the soil and prevent it from freezing, the glycol solution thereby being cooled. A compression type refrigerating system, utilizing a volatile refrigerant, has a compressor, condenser and evaporator, and a liquid line for conveying warm liquid refrigerant from the condenser to the evaporator. There are heat exchange means provided for exchanging heat between the warm liquid refrigerant flowing in the liquid line from the condenser to the evaporator and the cooled glycol solution, whereby the liquid refrigerant is cooled and the glycol solution is warmed.

BRIEF DESCRIPTION OF THE DRAWINGS

The foregoing summary as well as the following description of the preferred embodiments of the present invention will be better understood when read in conjunction with the appended drawings. For the purpose of illustrating the invention, there are shown in the drawings embodiments which are presently preferred. It should be understood, however, that the invention is not limited to the specific instrumentalities or the precise arrangements disclosed.

DETAILED DESCRIPTION OF THE INVENTION

Figure 1:
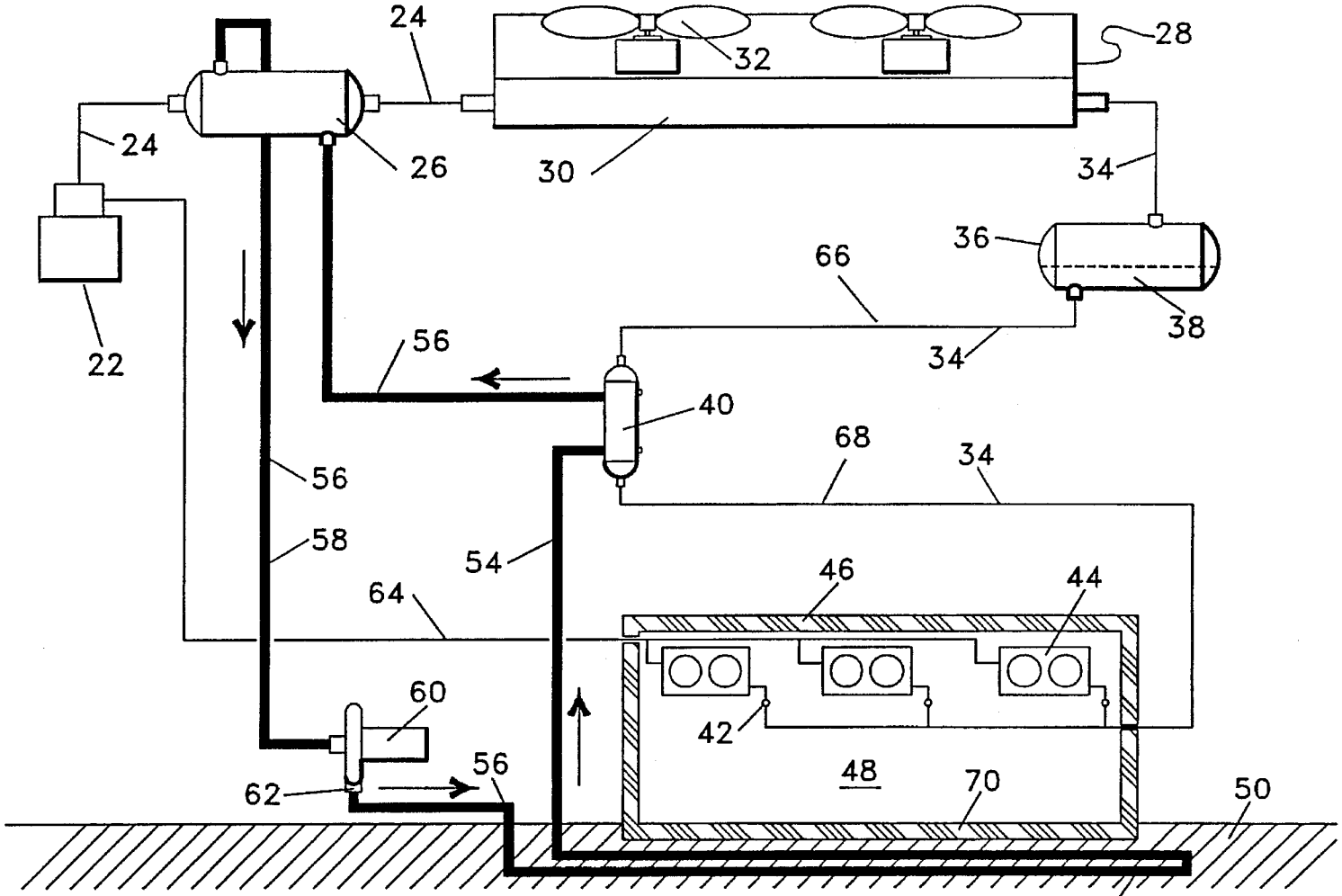
FIG. 1 is a schematic representation of a refrigeration system having an air-cooled condenser and a freezer, the combination embodying one principle of the present invention.

Referring now to the drawings, wherein like references are used to indicate like elements, there is shown in FIG. 1 a freezer 48 having an insulated enclosure 46 with an insulated floor 70 resting on grade 50. In some constructions a concrete base slab 72 (FIG. 2), is poured on grade, and the freezer enclosure, including insulated floor 70, is erected on the slab 72.

Freezers can range in temperature from slightly below the freezing point of water, 32 F. to very low temperatures, such as −100 F. or even lower, though the normal range of freezer temperatures used for food storage or food processing is from +5 F. to −40 F.

The material on grade is soil through which moisture can migrate. The term soil, as applied here means any porous or semi-porous material. The material under the freezer is not part of the present invention. Positioned within the soil under the freezer are pipes 52 through which flows a heat transfer fluid.

In still other designs there is no floor insulation. In such a case the heat flow from the soil into the freezer is quite large, but the soil must still be maintained above 32 F. to prevent heaving and a relatively large amount of heat must be supplied to the soil by way of pipes 52 and the heated fluid which is circulated through them.

The heat transfer fluid is most commonly a 50 percent solution of ethylene glycol and water. Since water solutions of ethylene glycol are highly corrosive, corrosion inhibitors are added to prevent or reduce corrosion of the materials employed in the fluid circuit. Other fluids having potential use for this purpose are methyl or ethyl alcohol, propylene glycol and any one of a multitude of proprietary materials offered by companies such as DuPont and Dow.

Gases and vapor can also be employed for the purposes of the present invention though containing and circulating gaseous materials is more difficult than containing liquids.

In FIG. 1 the refrigeration system to which the cooling effect of the cold glycol is applied has single stage compressor 22 discharging compressed refrigerant vapor through discharge line 24 to air-cooled condenser 28. Condenser 28 employs fans and motors 32 for drawing ambient air over heat transfer coil 30. The high pressure refrigerant from compressor 22 traverses coil 30, therein being cooled and giving up its latent heat of condensation to the airstream which is caused to flow over coil 30 by fans 32. The liquid refrigerant flows from condenser coil 30 to the evaporators 44, which are positioned within freezer 48, by way of conduit 34.

Within conduit 34 many operational and control elements may be positioned. In FIG. 1 receiver 36 is shown positioned in conduit 34. Receiver 36 has stored therein a pool of condensed liquid refrigerant 38. Subcooling heat exchanger 40 is connected between receiver 36 and evaporators 44. The segment 66 of conduit 34 connects the outlet of receiver 36 with the inlet of sub-cooling heat exchanger 40. The segment 68 of conduit 34 connects the outlet of sub-cooling heat exchanger 40 with evaporators 44. Expansion valves 42 positioned in branch conduits at the end of conduit 34, segment 68, control flow of the sub-cooled liquid refrigerant to each evaporator 44.

Within each evaporator 44, the liquid refrigerant, having had its pressure and temperature reduced by expansion valve 42, now evaporates to a vapor, thereby cooling air within the freezer 48. The vapor is drawn back to compressor 22 through suction conduit 64 after which the entire process of compression, condensation, sub-cooling, expansion and cooling is repeated.

In FIG. 1 sub-cooling heat exchanger 40 is shown as shell and tube type. The exact construction of heat exchanger 40 is unimportant in the concept of the invention. Shell and coil, plate type, tube-in-tube or other heat exchanger designs capable of transferring the desired amount of heat at small temperature differences will work satisfactorily. Since it is generally desirable to limit the quantity of volatile refrigerant in a system, both for economy and for safety, good design practice suggests that in a shell type heat exchanger the refrigerant liquid should traverse the tubes and the glycol solution traverse the shell.

In FIG. 1 the glycol circuit includes motorized pump 60 having outlet 62. The warmed glycol solution pressurized by pump 60 is delivered to conduit 56 from which it flows through conduits 52 positioned under the freezer floor 70 in a warming relationship with ground 50. While the warmed glycol solution performs its anti-freezing and warming function under the freezer floor 70, the glycol solution is cooled, typically to 40 to 45 F. The 45 F. glycol solution flows to sub-cooling heat exchanger 40 via conduit 54. In the sub-cooling heat exchanger 40, the liquid refrigerant flowing to the evaporators is cooled to about 60 F. and the cooled glycol solution simultaneously is warmed from about 45 F. to about 50 F. The exact temperatures of glycol and refrigerant are dependent in part on the amount of heat transfer through the freezer floor, the flow rate of the glycol solution provided by the pump 60, the freezer temperature, the condensing temperature of the refrigerant in condenser 30 and whether supplemental sub-cooling of the liquid refrigerant, described in connection with FIGS. 2 and 3, is provided.

When the freezer floor 70 is well insulated and or the freezer temperature is relatively high, typically +10 to −5 F., not much heat is transferred through the floor and the heat lost by the warmed glycol solution is readily restored by heat exchanger 40 alone, especially under warm weather or heavy freezer usage conditions when the use factor of the refrigeration system is high.

However, when the freezer temperature is very low, in the −20 F. to −40 F. range, substantially more heat is transferred through the freezer floor 70, thereby increasing the floor heating requirements. Under conditions of low freezer usage or low outdoor ambients, when the use factor of the refrigeration system is low, then the heating effect on the glycol, secured through sub-cooling the liquid refrigerant flowing to the evaporators 44, may not be sufficient to restore to the glycol the heat lost in heating the soil 50 under the freezer. In that case it becomes desirable to provide a supplemental source of heat. In FIG. 1 heat exchanger 26 is installed in the discharge line 24 of compressor 22. Glycol solution warmed by heat exchanger 40 is delivered via conduit 56 to heat exchanger 26 where it is subjected to the hot vapor discharged by compressor 22 and heated. The heated glycol then is drawn out of heat exchanger 26, through conduit 58, by pump 60 and pumped again into and through conduits 52 whereby the floor under the freezer floor 70 is warmed and thereby prevented from freezing and heaving.

Figure 2:
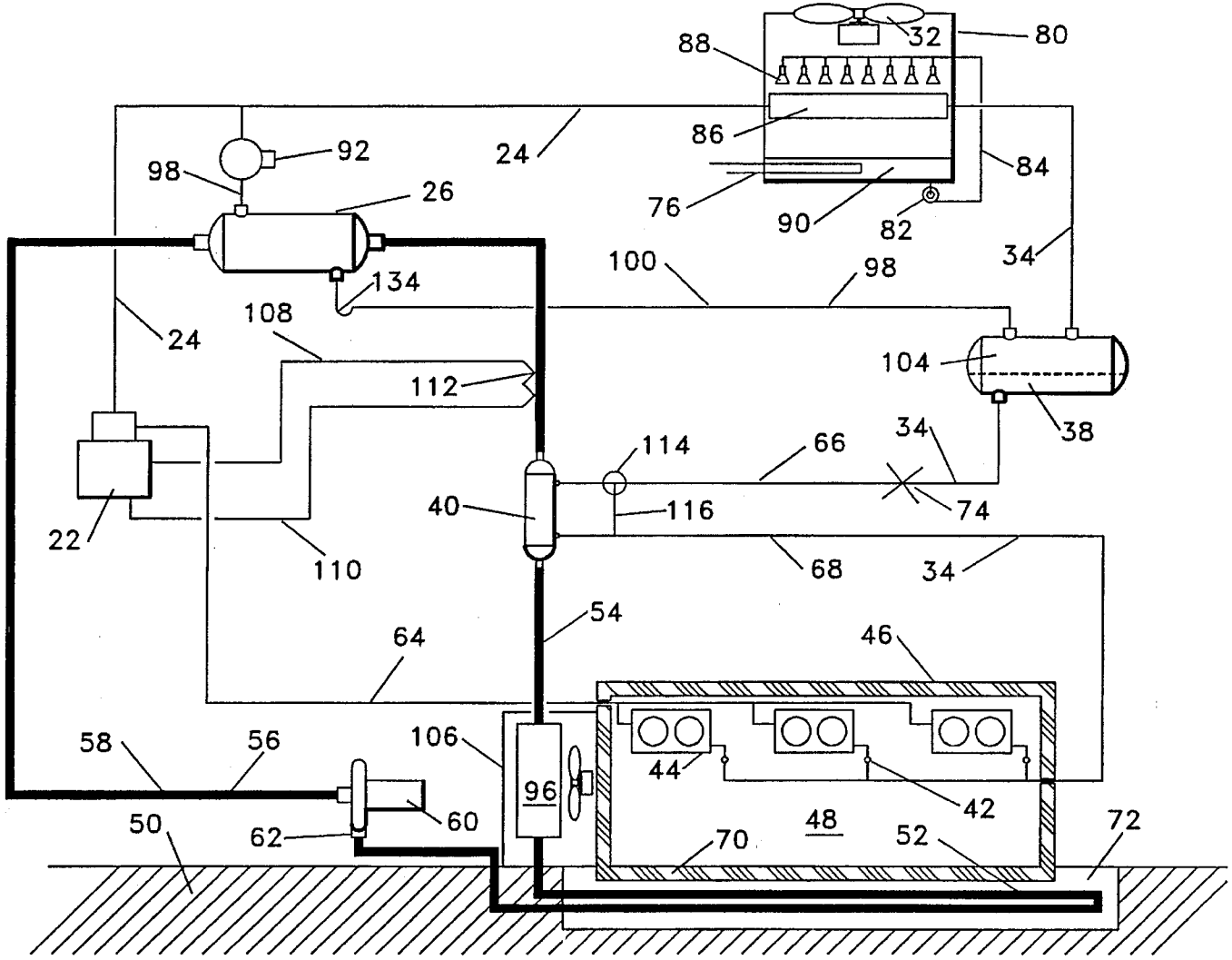
FIG. 2 shows a freezer having an ante-room cooled by an embodiment of the invention and a refrigeration system having an evaporative condenser.
Figure 3:
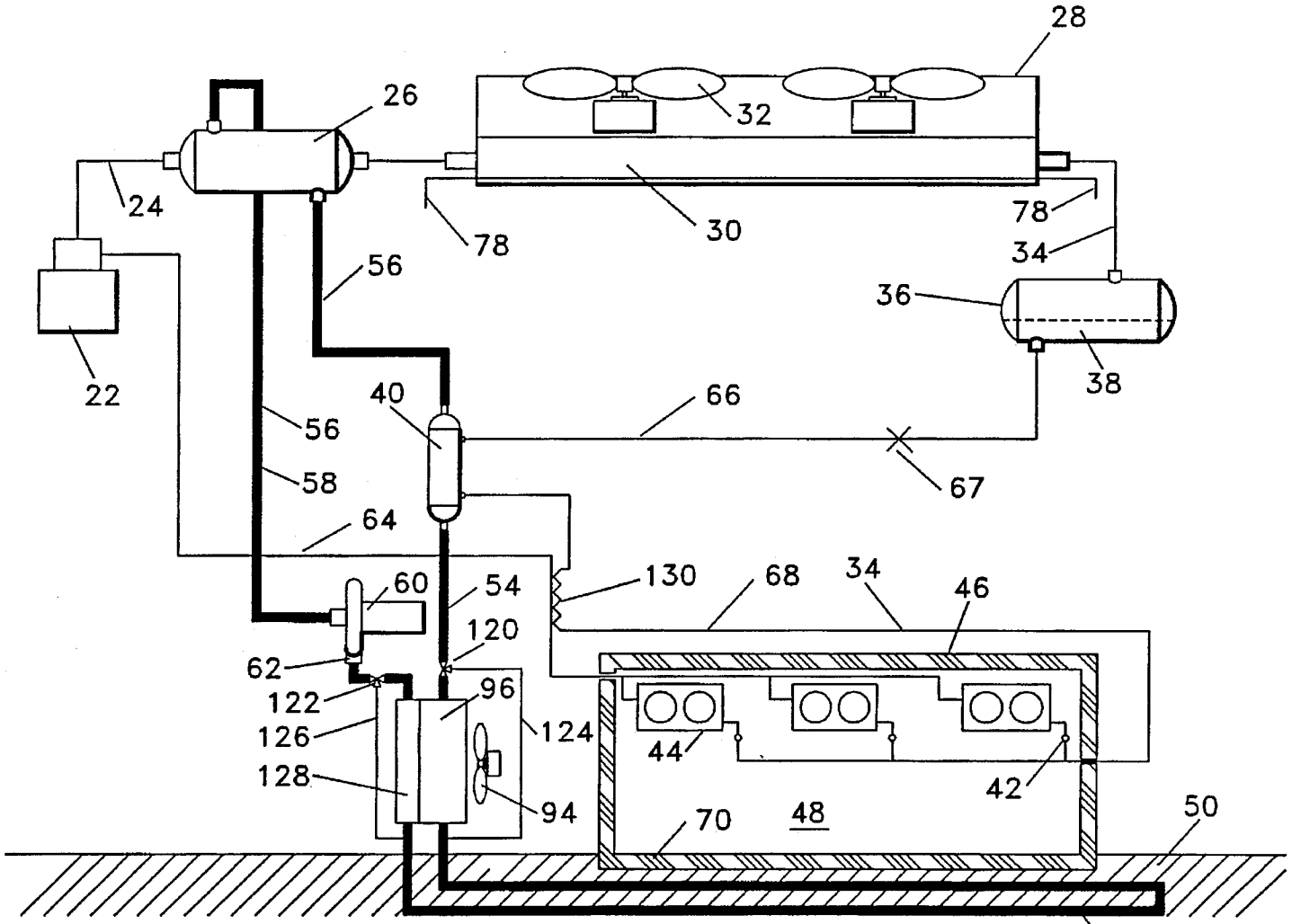
FIG. 3 shows an embodiment of the present invention further including a suction to liquid heat exchanger.

In FIG. 2 the refrigeration cycle and the glycol cycle are substantially the same as described in FIG. 1, with the following exceptions. In FIG. 2 the supplementary heat exchanger 26 is still heated by hot gas discharged by compressor 22, except the heat exchanger 26 is installed in conduit 98 which bypasses the condenser. That is, bypass 98 connects between discharge line 24 and receiver 104. Though receiver 104 is shown with two inlets, one for connection to conduit 34 from the condenser outlet, and a second for connection to bypass conduit 98, equivalent results could be achieved by connecting conduit 98 to conduit 34, thereby allowing receiver 36 of FIG. 1, which has only a single inlet to be employed.

In FIG. 2, referring again to supplementary heat exchanger 26, there is provided in conduit 98 at the hot gas inlet of heat exchanger 26 a control valve 92. Control valve 92 is an electrically controlled solenoid valve whose open and closed condition is governed by a thermostat, not shown, positioned to sense the temperature of the soil 50 under the freezer floor. In alternate embodiments, the thermostat is positioned to sense some temperature related to the temperature of the sub-freezer soil 50 such as the temperature of the glycol solution as it leaves sub-freezer conduits 52 or any other position whose temperature is related to the sub-freezer temperature.

Supplementary heat exchanger 26 acts to heat the glycol solution circulated to it by conduit 56 by removing sufficient heat from the refrigerant vapor to condense it. In the bypass conduit 98, the heat exchanger 26 now becomes a condenser piped in parallel with condenser 80.

Condenser 80 is an evaporative condenser. That is, it performs its function of removing heat from the compressed volatile refrigerant gas delivered to it by compressor 22 by subjecting its heat transfer coil 86 to a simultaneous flow of both air, moved by fan motor combination 32, and a water spray provided by water pumped from sump 90 to spray nozzles 88 by water pump 82. Though evaporative condenser usually provide lower condensing temperatures than the air-cooled condenser of FIG. 1, the use of water as coolant sometimes has the effect of increasing the required maintenance.

Conduit 100, the portion of conduit 98 connecting supplementary heat exchanger 26 with the receiver inlet has installed trap 134. The function of trap 134 is to facilitate flow of refrigerant liquid, condensed in heat exchanger 26, to receiver 104 while minimizing gas flow in the reverse direction.

It is common to attempt to provide improved performance in systems of this type by routing the warm liquid refrigerant leaving receiver 104 through a sub-cooling coil 76 positioned within the sump 90 of the condenser. The connection to the liquid line is made at point 74, marked with an X. The liquid line is broken at that point and connected to the sub-cooling coil 76.

While heating the sub-freezer floor to prevent freezing and heaving is very important, it is also important not to overheat the sub-freezer floor. Good practice suggests maintaining the soil at about 35 F.–40 F. Under summer conditions when the ground is already warm and condensing temperatures are high, there may be a tendency for the warm liquid flowing through heat exchanger 40 to heat the glycol flowing in conduit 56, 58, 52 to a higher temperature than necessary even when solenoid valve 92 is closed and heat exchanger 26 is effectively inoperative. To cope with this situation, three-way valve 114 is provided in liquid line 66 to allow warm liquid refrigerant to bypass around sub-cooling heat exchanger 40 and instead flow direct to the evaporators 44 through bypass conduit 116. Individual solenoid valves may be employed instead of three way valve 114 to achieve the same effect.

Large compressors used for low temperature or freezer service, frequently require external oil cooling to prevent overheating and thermal degradation of the lubricant. In an alternate embodiment of the present invention there is provided oil cooling heat exchanger 112 which is connected to exchange heat between the hot oil circulated to and from the compressor 22 via conduits 108 and 110 and the glycol solution discharged by sub-cooling heat exchanger 40. In one embodiment of the invention, heat exchanger 112 allows supplementary heat exchanger 26 to be eliminated.

Large freezers are sometimes constructed on a concrete pad 72 which is poured on grade. In such a case, glycol conduits 52 are embedded in the sub-freezer concrete slab 72 with exactly the same effect as if the glycol conduits had been positioned directly within soil 50. In an alternative construction, conduits 52 are positioned in soil 50 under slab 72.

It is common to provide a space 106 adjacent large freezers for various purposes. Cooling coil 96 and fan 94 (FIG. 3) are provided to utilize some of the cooling effect of the cooled glycol leaving the sub-freezer floor to provide cooling within such space. The space may be used as an air-conditioned office within which clerks and managers work or as a cooled entry vestibule through which all people and vehicles must pass to gain entry to the freezer, thereby reducing the load on the freezer by minimizing inflow of hot ambient air when the freezer door is opened.

FIG. 3 is similar to the structure of FIG. 1 except that glycol—air heat exchanger 96 with fan 94, has been inserted at the outlet of sub-freezer conduit 52. A three-way valve 120 is installed at the junction of bypass conduit 124 and glycol conduit 54. The three way valve 120 is actuated in response to the need for cooling in the enclosure shown in FIG. 2. When cooling within the enclosure is required, three way valve 120 directs cold glycol from the sub-freezer conduit 52 through the cooling coil 96. When no further cooling is required within the enclosure, three way valve 120 shifts and causes the cold glycol from sub-freezer conduit 52 to flow directly to the sub-cooling heat exchanger 40.

Further, in FIG. 3 there is provided an air—glycol heat exchanger 128 which can provide additional heat to the glycol entering the sub-freezer coil 52 should such addition be necessary. Three way valve 122 and bypass 126 are provided to allow the heat exchanger 128 to function or to be bypassed as desired by the operating conditions.

In FIG. 3, suction—liquid heat exchanger 130 is provided for exchanging heat between liquid line 34, 68 and suction line 64. Suction—liquid heat exchanger 130 further cools liquid refrigerant leaving sub-cooling heat exchanger 40 enroute to evaporators 44.

In FIG. 3 sub-cooling tubes 78 have been provided as part of air cooled condenser coil 30. Warm liquid refrigerant from liquid conduit 66, which is broken at point 67, is directed through tubes 78, thereby securing 5F to 10F additional sub-cooling before the liquid refrigerant enters sub-cooler 40.

Figure 4:
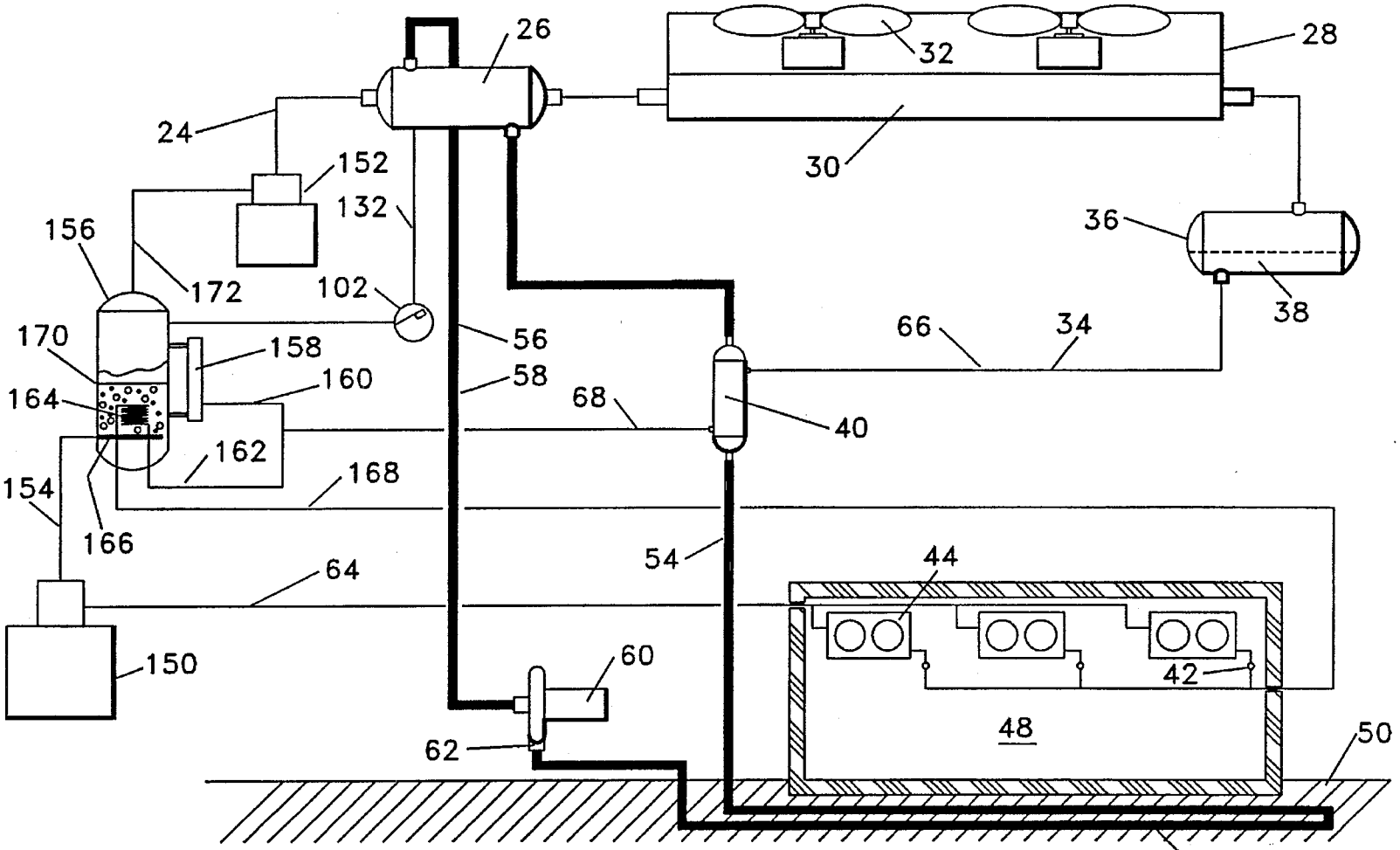
FIG. 4 is a schematic representation of a grade mounted freezer with a refrigeration system employing a compound compression arrangement with flooded intercooler.

FIG. 4 is substantially the same as FIG. 1 with the following major change: The single stage compressor 22 of FIG. 1 has been replaced by a two stage compound compression compressor system having a flooded intercooler and sub-cooling coil. In FIG. 4 low stage compressor 150 acts to withdraw refrigerant vapor from evaporators 44 via suction conduit 64. The low pressure refrigerant vapor is compressed to a higher pressure, called the interstage pressure and is discharged into low stage discharge line 154.

A flooded intercooler 156 is supplied within which a pool of liquid refrigerant is maintained having a level 170. The level 170 is established and maintained by float valve 158. Float valve 158 receives liquid refrigerant from receiver 36 via liquid line 34, 66, sub-cooler 40 and sub-cooled liquid line 68. Sub-cooled liquid line 68 is branched into two conduits, 160 and 162. Branch 160 provides flow to the float valve 158 to maintain the level 170 in the flooded intercooler 156. Branch 162 provides liquid refrigerant flow to sub-cooling coil 164.

Sub-cooling coil 164 is immersed in the pool of liquid refrigerant within intercooler 156 and serves to cool liquid refrigerant through it, into conduit 168, to a temperature about 5 to 10 F. higher than the saturation temperature of the interstage. Saturation temperature is the temperature corresponding to the actual pressure. A typical interstage saturation temperature for a two stage compound compression system condensing at 110 F. and having a evaporating temperature of −20 F. would be 25 F.

Within flooded intercooler 156, positioned entirely below liquid level 170, is a gas distributor 166, which is fabricated with many holes through which the hot refrigerant vapor discharged by low stage compressor 150 bubbles into and through the liquid pool within the flooded intercooler 156 and is thereby cooled. It is this cooling function of the hot gas discharged by the low stage compressor 150 enroute to high stage compressor 152 which, gives the intercooler its name.

Since heat exchanger 26 may act to condense refrigerant vapor flowing to it through conduit 24, drain conduit 132 is provided to drain liquid refrigerant from heat exchanger 26 to flooded intercooler 156. Float valve 102 is provided to allow liquid refrigerant to flow, but to prevent the flow of vapor.

For outdoor summer conditions where the ambient is 90 F., in a typical system employing the principles of the present invention as shown in FIG. 4, the condensing temperature will be 105 F., the liquid leaving condenser coil 30 and entering receiver 36 and subsequently entering sub-cooler 40, will be at 100 F. The liquid refrigerant leaving sub-cooler 40 and entering submerged sub-cooling coil 164 will be at 90 F. and the liquid refrigerant leaving submerged sub-cooling coil 164 will be 20 F. to 35 F., approximately 10 F. warmer than the 10 F. to 25 F. saturation temperature of the interstage. These temperatures are for illustration only and should be expected to vary widely depending on the type of condenser employed, the outside ambient dry bulb and wet bulb temperatures, the temperature of freezer 48 and the temperature at which coil 52 is maintained.

The high stage compressor 152 receives all the vapor discharged by low stage compressor 154 plus all the vapor generated in flooded intercooler 156. Vapor is generated in flooded intercooler 156 from four sources: from the discharge gas of the low stage compressor 150; from the liquid from the pool evaporated in cooling the hot low-stage discharge gas, from gas generated by the effect of cooling liquid refrigerant flowing through sub-cooling coil 164 and from flash gas arising from the process of self cooling the liquid refrigerant fed through float valve 158. Naturally, the smaller the quantity of gas that high stage compressor 152 has to pump, the more efficient will be the entire system. Sub-cooling heat exchanger 40, by cooling liquid refrigerant flowing both to float valve 158 and to sub-cooling coil 164, thereby performs a dual beneficial function, by precooling liquid refrigerant flowing to float valve 158 it reduces the flash gas generated when the liquid flows into the flooded intercooler, and by precooling liquid refrigerant flowing to sub-cooling coil 164, there is imposed a smaller sub-cooling load and a reduction in gas generated.

The function of the remainder of the system of FIG. 4 and of the freezer is the same as described in connection with FIG. 1.

Figure 5:
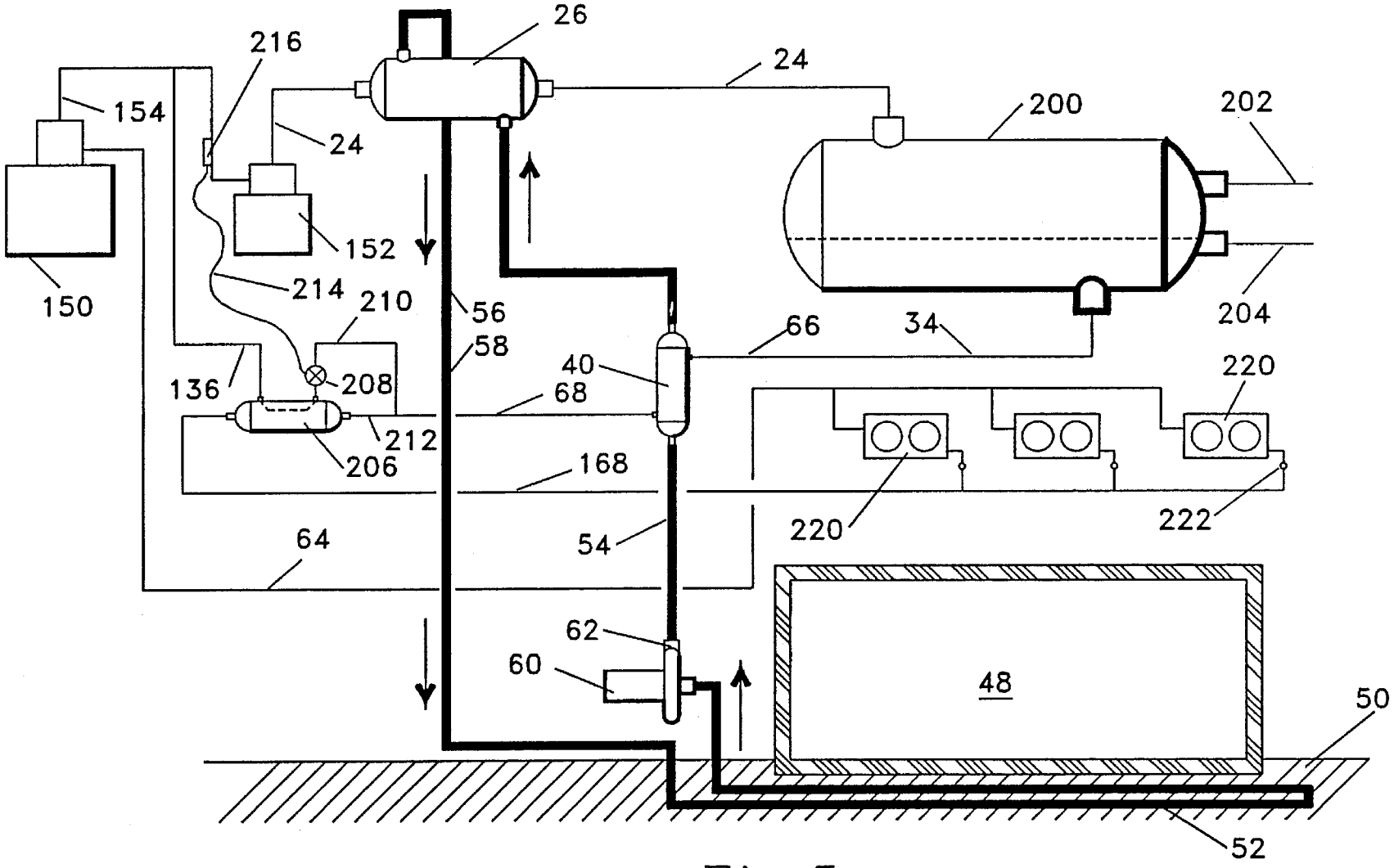
FIG. 5 shows a compound compression system using a water-cooled condenser and having a direct expansion intercooler/sub-cooler, where the evaporators are positioned outside the freezer.

In FIG. 5 there is shown a freezer 48 and a refrigeration system employing a compound compression system but with a direct expansion sub-cooler and intercooler 206. In FIG. 5, low stage compressor 150 delivers its discharge vapor directly to the suction inlet of high stage compressor 152 via interstage conduit 154. A liquid sub-cooling heat exchanger 206 is provided which is cooled by flow of evaporating liquid refrigerant fed by and under the control of thermostatic expansion valve 208. The superheat sensing bulb 216 of thermal expansion valve (TXV) 208 is positioned in thermal contact with interstage conduit 154 on the down-stream side of the point where over-spill conduit 134 is connected to interstage conduit 154. In that position it is sensitive to the temperature of the refrigerant vapor flowing into the suction of high stage compressor 152 and causes TXV 208, which it controls, to feed enough liquid refrigerant from liquid line branch 210 to flood through direct expansion sub-cooling heat exchanger 206 and into interstage conduit 154, thereby cooling the low stage discharge gas flowing through it before its entry into the suction of high stage compressor 152.

In FIG. 5 the evaporators 220, which otherwise could be identical in physical construction with evaporators 44 (positioned within freezer 48 in FIG. 1), are now positioned outside freezer 48. This external positioning of the evaporators is intended to signify that the cooling or sub-cooling effect of the glycol cooled while circulating in heat transfer relation with the soil under freezer 48 is effectively applied to provide liquid refrigerant sub-cooling to refrigerant flowing in a system which is not employed to cool the freezer 48, but instead extends its cooling function for some other purpose. Such purposes could include the liquid sub-cooling for a refrigeration system serving an ultra-low temperature freezer, an ice-maker, or any other cooling function which such cooling effect could be conveniently or economically employed.

Note that in FIG. 5, the glycol pump 60 is positioned to withdraw glycol solution from sub-freezer coil 52, in contrast to the pump orientation in FIG. 1 where the pump 60 discharge into sub-freezer coil 52. However, in both pump orientations the flow direction of the glycol solution is from the coil 52 to the sub-cooling heat exchanger 40.

In another embodiment of the invention, compressors 150 and 152 are combined within a single body. In still another embodiment, compressors 150 and 152 are replaced by a single screw compressor having an economizer port, and overspill conduit 136 is connected to the economizer port on the screw compressor.

From the foregoing description, it can be seen that the present invention comprises an unusual use for the cooling effect generated during the process of heating the soil on which a freezer floor rests. It will be appreciated by those skilled in the art that changes could be made to the embodiments described in the foregoing description without departing from the broad inventive concept thereof. It is understood, therefore, that this invention is not limited to the particular embodiment or embodiments disclosed, but is intended to cover all modifications which are within the scope and spirit of the invention as defined by the appended claims.

I claim:

1. A refrigeration system having a refrigerant vapor producing evaporator, compressor means for withdrawing the vapor from the evaporator and compressing the vapor to a higher pressure and discharging it, condenser means for receiving the compressed vapor and condensing it to a warm refrigerant liquid, first conduit means for conveying the compressed vapor from the compressor to the condenser means, expansion means for receiving the higher pressure liquid and reducing its pressure, second conduit means for conveying the warm refrigerant liquid to the expansion means from the condensing means;

a freezer enclosure having an interior maintained at a temperature below 32 F., said freezer enclosure having a floor positioned on sub-floor material subject to being cooled to a moisture freezing temperature from the effect of the freezer positioned above, third conduit means for conveying a warmed fluid in heat transfer relation to the sub-floor material for transferring heat to the sub-floor material, whereby the sub-floor material is maintained above the freezing temperature of moisture and the fluid is cooled, the third conduit means having an inlet for receiving the warmed fluid and an outlet for discharging the cooled fluid; and means for circulating and heating the fluid, said means comprising: pump means for circulating the fluid, first heat exchange means for exchanging heat between the cooled fluid and the warm refrigerant liquid flowing in the second conduit means, and fourth conduit means for conveying the cooled fluid from the third conduit means to the first heat exchange means, whereby the warm refrigerant liquid is cooled and the cooled fluid is warmed;

fifth conduit means connecting the first conduit means with the second conduit means, second heat exchange means positioned in the fifth conduit means for exchanging heat between refrigerant vapor discharged by the compressor and the warmed fluid discharged by the first heat exchange means whereby the fluid warmed by the first heat exchange means is further warmed by the second heat exchange means, and further including valve means positioned in the portion of the fifth conduit means joining the first conduit means with the second heat exchange means, whereby flow from the first conduit means to the second heat exchange means is subject to the control of the valve means.

2. A refrigeration system as recited in claim 1 further providing means for sensing a temperature related to the temperature of the sub-floor material and closing the valve means on a rise of said temperature and opening the valve means on a drop in the temperature of the sub-floor material, whereby the temperature of the sub-floor material is controlled within a desired range.

3. A refrigeration system as recited in claim 2 where the related temperature is the temperature of the fluid discharged by the third conduit means.

4. A refrigeration system having a refrigerant vapor producing evaporator, compressor means for withdrawing the vapor from the evaporator and compressing the vapor to a higher pressure and discharging it, said compressor means including a low pressure compressor means for withdrawing the refrigerant vapor from the evaporator and discharging it at higher pressure and a high pressure compressor means for receiving the higher pressure vapor and compressing it and discharging it, condenser means for receiving the compressed vapor and condensing it to a warm refrigerant liquid, first conduit means for conveying the compressed vapor discharged from the high pressure compressor means to the condenser means, expansion means for receiving the higher pressure liquid and reducing its pressure, second conduit means for conveying the warm refrigerant liquid to the expansion means from the condensing means;

a freezer enclosure having an interior maintained at a temperature below 32 F., said freezer enclosure having a floor positioned on sub-floor material and subject to being cooled to a moisture freezing temperature from the effect of the freezer positioned above, third conduit means for conveying a warmed fluid in heat transfer relation to the sub-floor material for transferring heat to the sub-floor material, whereby the sub-floor material is maintained above the freezing temperature of moisture and the fluid is cooled, the third conduit means having an inlet for receiving the warmed fluid and an outlet for discharging the cooled fluid; and means for circulating and heating the fluid, said means comprising: pump means for circulating the fluid, first heat exchange means for exchanging heat between the cooled fluid and the warm refrigerant liquid flowing in the second conduit means, and fourth conduit means for conveying the cooled fluid from the third conduit means to the first heat exchange means, whereby the warm refrigerant liquid is cooled and the cooled fluid is warmed and second heat exchange means for exchanging heat between refrigerant vapor discharged by the compressor and the warmed fluid discharged by the first heat exchange means, whereby the fluid warmed by the first heat exchange means is further warmed by the second heat exchange means.

5. A refrigeration system as recited in claim 4 further including a flooded intercooler having therein a pool of liquid refrigerant having a level, the flooded intercooler being positioned to receive the higher pressure refrigerant discharged by the low pressure compressor means, distribution means for cooling the higher pressure refrigerant vapor by bubbling the said refrigerant vapor through the pool of liquid refrigerant maintained therein, and further including expansion means subject to the level of refrigerant in the pool, the expansion means being connected to receive liquid refrigerant from the second conduit means via the first heat exchange means.

6. A refrigeration system as recited in claim 5 further providing a sub-cooling conduit positioned within the flooded intercooler and below the level of the pool of liquid refrigerant therein, the sub-cooling conduit being connected to receive liquid refrigerant from the second conduit means via the first heat exchange means.

7. A refrigeration system as recited in claim 6 where the condenser type is selected from the group consisting of air-cooled, water-cooled, and evaporative.

8. A refrigeration system as recited in claim 4, further including expansion means connected to receive liquid refrigerant from the second conduit means via the first heat exchange means and to discharge refrigerant into the discharge of the low pressure compressor means.

9. A refrigeration system having a refrigerant vapor producing evaporator, compressor means for withdrawing the vapor from the evaporator and compressing the vapor to a higher pressure and discharging it, said compressor having a lubricant, condenser means for receiving the compressed vapor and condensing it to a warm refrigerant liquid, first conduit means for conveying the compressed vapor from the compressor to the condenser means, expansion means for receiving the higher pressure liquid and reducing its pressure, second conduit means for conveying the warm refrigerant liquid to the expansion means from the condensing means;

a freezer enclosure having an interior maintained at a temperature below 32 F., said freezer enclosure having a floor positioned on sub-floor material and subject to being cooled to a moisture freezing temperature from the effect of the freezer positioned above, third conduit means for conveying a warmed fluid in heat transfer relation to the sub-floor material for transferring heat to the sub-floor material, whereby the sub-floor material is maintained above the freezing temperature of moisture and the fluid is cooled, the third conduit means having an inlet for receiving the warmed fluid and an outlet for discharging the cooled fluid; and means for circulating and heating the fluid, said means comprising: pump means for circulating the fluid, first heat exchange means for exchanging heat between the cooled fluid and the warm refrigerant liquid flowing in the second conduit means, and fourth conduit means for conveying the cooled fluid from the third conduit means to the first heat exchange means, whereby the warm refrigerant liquid is cooled and the cooled fluid is warmed;

further providing a flow of heated compressor lubricant, heat exchanger means for exchanging heat between the warmed fluid discharged by the first heat exchanger means and the compressor lubricant whereby the fluid is further warmed and the compressor lubricant is cooled.

10. A refrigeration system having a refrigerant vapor producing evaporator, compressor means for withdrawing the vapor from the evaporator and compressing the vapor to a higher pressure and discharging it, condenser means for receiving the compressed vapor and condensing it to a warm refrigerant liquid, first conduit means for conveying the compressed vapor from the compressor to the condenser means, expansion means for receiving the higher pressure liquid and reducing its pressure, second conduit means for conveying the warm refrigerant liquid to the expansion means from the condensing means; a freezer enclosure having an interior maintained at a temperature below 32 F., said freezer enclosure having a floor positioned on sub-floor material and subject to being cooled to a moisture freezing temperature from the effect of the freezer positioned above, third conduit means for conveying a warmed fluid in heat transfer relation to the sub-floor material for transferring heat to the sub-floor material, whereby the sub-floor material is maintained above the freezing temperature of moisture and the fluid is cooled, the third conduit means having an inlet for receiving the warmed fluid and an outlet for discharging the cooled fluid; and means for circulating and heating the fluid, said means comprising: pump means for circulating the fluid, first heat exchange means for exchanging heat between the cooled fluid and the warm refrigerant liquid flowing in the second conduit means, and fourth conduit means for conveying the cooled fluid from the third conduit means to the first heat exchange means, whereby the warm refrigerant liquid is cooled and the cooled fluid is warmed, and further providing a flow of heated compressor lubricant, heat exchanger means for exchanging heat between the warmed fluid discharged by the first heat exchanger means and the compressor lubricant whereby the fluid is further warmed and the compressor lubricant is cooled.

11. A freezer having a floor, a fluid conveying conduit positioned beneath and in thermal contact with the floor, means for providing a flow of warm fluid to the under-floor conduit, whereby the under-floor is warmed and a cooler fluid is discharged, a refrigeration system having condenser means for receiving refrigerant vapor and for discharging warm refrigerant liquid to a liquid line, an evaporator receiving liquid from the liquid line, where the evaporator provides no cooling effect to the freezer, a first heat exchanger positioned in the liquid line for subjecting the warm liquid refrigerant to the cooling effect of the cooler fluid; and first conduit means for conveying the cooler fluid to the heat exchanger from the under-floor conduit for cooling the warm liquid refrigerant and warming the fluid.

12. A refrigeration system having a refrigerant vapor producing evaporator, compressor means for withdrawing the vapor from the evaporator and compressing the vapor to a higher pressure and discharging it, condenser means for receiving the compressed vapor and condensing it to a warm refrigerant liquid, first conduit means for conveying the compressed vapor from the compressor to the condenser means, expansion means for receiving the higher pressure liquid and reducing its pressure, second conduit means for conveying the warm refrigerant liquid to the expansion means from the condensing means;

a freezer enclosure having an interior maintained at a temperature below 32 F., said freezer enclosure having a floor positioned on sub-floor material and subject to being cooled to a freezing temperature from the effect of the freezer positioned above, third conduit means for conveying a warmed single phase heat transfer liquid in heat transfer relation to the sub-floor material for transferring heat to the sub-floor material, whereby the sub-floor material is maintained above the freezing temperature of the moisture and the single phase heat transfer liquid is cooled, the third conduit means having an inlet for receiving the warmed single phase heat transfer liquid and an outlet for discharging the cooled single phase heat transfer liquid; and means for circulating and heating the single phase heat transfer liquid, said means comprising: pump means for circulating the single phase heat transfer liquid, first heat exchange means for exchanging heat between the cooled single phase heat transfer liquid and the warm refrigerant liquid flowing in the second conduit means, and fourth conduit means for conveying the cooled single phase heat transfer liquid from the third conduit means to the first heat exchange means, whereby the warmed refrigerant liquid is cooled and the cooled single phase heat transfer liquid is warmed.

13. A refrigeration system as recited in claim 12 further including second heat exchange means for exchanging heat between refrigerant vapor discharged by the compressor and the warmed single phase heat transfer liquid discharged by the first heat exchange means, whereby the single phase heat transfer liquid warmed by the first heat exchange means is further warmed by the second heat exchange means.

14. A refrigeration system as recited in claim 13 where the second heat exchange means is positioned in the first conduit means, in series relationship with the condenser.

15. A refrigeration system as recited in claim 13 where the second heat exchange means is positioned in a fifth conduit connecting the first conduit means with the second conduit means, thereby bypassing the condenser means.

16. A refrigeration system as recited in claim 15 further providing valve means positioned in the portion of the fifth conduit means joining the first conduit means with the second heat exchange means, whereby flow from the first conduit means to the second heat exchange means is subject to the control of the valve means.

17. A refrigeration system as recited in claim 16 further providing means for sensing a temperature related to the temperature of the sub-floor material and closing the valve means on a rise of said temperature and opening the valve means on a drop in the temperature of the sub-floor material, whereby the temperature of the sub-floor material is controlled within a desired range.

18. A refrigeration system as recited in claim 17 where the related temperature is the temperature of the single phase heat transfer liquid discharged by the third conduit means.

19. A refrigeration system as recited in claim 13 where the compressor includes a low pressure compressor means for withdrawing the refrigerant vapor from the evaporator and discharging it at higher pressure and a high pressure compressor means for receiving the higher pressure vapor and compressing it and discharging it into the first conduit means.

20. A refrigeration system as recited in claim 19 further including a flooded intercooler having therein a pool of liquid refrigerant having a level, the flooded intercooler being positioned to receive the higher pressure refrigerant discharged by the low pressure compressor means, distribution means for cooling the higher pressure refrigerant vapor by bubbling the said refrigerant vapor through the pool of liquid refrigerant maintained therein, and further including expansion means subject to the level of refrigerant in the pool, the expansion means being connected to receive liquid refrigerant from the second conduit means via the first heat exchange means.

21. A refrigeration system as recited in claim 20 further providing a sub-cooling conduit positioned within the flooded intercooler and below the level of the pool of liquid refrigerant therein, the sub-cooling conduit being connected to receive liquid refrigerant from the second conduit via the first heat exchange means.

22. A refrigeration system as recited in claim 21 where the condenser type is selected from the group consisting of air-cooled, water-cooled, and evaporative.

23. A refrigeration system as recited in claim 19, further including expansion means connected to receive liquid refrigerant from the second conduit means via the first heat exchange means and to discharge refrigerant into the discharge of the low pressure compressor means.

24. A refrigeration system as recited in claim 13 where the evaporator is positioned to cool the interior of the freezer enclosure.

25. A refrigeration system as described in claim 13 further providing an air-filled enclosure having a temperature warmer than the freezer enclosure, the air filled enclosure being positioned substantially adjacent the freezer enclosure, third heat exchange means for exchanging heat between the air in the adjacent enclosure and the single phase heat transfer liquid conveyed to it from the third conduit means, whereby the single phase heat transfer liquid conveyed to it from the third conduit means is warmed and the air within the adjacent enclosure is cooled.

26. A refrigeration system as recited in claim 12 further providing a flow of heated compressor lubricant, heat exchanger means for exchanging heat between the warmed single phase heat transfer liquid discharged by the first heat exchanger means and the compressor lubricant whereby the single phase heat transfer liquid is further warmed and the compressor lubricant is cooled.

27. A freezer having a floor, a single phase heat transfer liquid conveying conduit positioned beneath and in thermal contact with the floor, means for providing a flow of warm single phase heat transfer liquid to the under-floor conduit, whereby the under-floor is warmed and a cooler single phase heat transfer liquid is discharged, a refrigeration system having condenser means for receiving refrigerant vapor and for discharging warm refrigerant liquid to a liquid line, a first heat exchanger positioned in the liquid line for subjecting the warm liquid refrigerant to the cooling effect of the cooler single phase heat transfer liquid;

and first conduit means for conveying the cooler single phase heat transfer liquid to the heat exchanger from the under-floor conduit for cooling the warm liquid refrigerant and warming the single phase heat transfer liquid.

28. A refrigeration system as recited in claim 27 further providing means for circulating the single phase heat transfer liquid between the under-floor conduit and the heat exchanger.

29. A refrigeration system as recited in claim 28 where the circulating means is a mechanical pump.

30. A refrigeration system as recited in claim 27 further providing an evaporator receiving liquid from the liquid line where the evaporator provides no cooling effect to the freezer.

31. A refrigeration system as recited in claim 27 further providing an evaporator receiving liquid from the liquid line, where the evaporator is positioned to provide cooling effect to the freezer.

* * * * *